United States Patent [19]

Furuya

[11] 4,307,556

[45] Dec. 29, 1981

[54] COIN IRREGULARITY PROCESS MACHINE FOR COIN PACKAGING MACHINE

[75] Inventor: Katusuke Furuya, Tokyo, Japan

[73] Assignee: Laurel Bank Machine Co., Ltd., Tokyo, Japan

[21] Appl. No.: 136,251

[22] Filed: Apr. 1, 1980

[51] Int. Cl.[3] ..... B65B 11/04; B65B 57/14

[52] U.S. Cl. ..... 53/54; 53/494; 53/532

[58] Field of Search ..... 53/494, 54, 56, 532, 53/212, 503, 504, 501, 447, 437, 525, 77; 133/1 A, 8 A

[56] References Cited

U.S. PATENT DOCUMENTS

| | | | |
|---|---|---|---|
| 3,469,365 | 9/1969 | Uchida et al. | 53/532 |
| 4,058,954 | 11/1977 | Asami | 53/494 X |
| 4,123,892 | 11/1978 | Asami | 53/54 |
| 4,162,598 | 7/1979 | Watanabe et al. | 53/54 |
| 4,195,463 | 4/1980 | Bergman et al. | 53/54 X |
| 4,235,061 | 11/1980 | Watanabe et al. | 53/54 |
| 4,249,363 | 2/1981 | Miyazaki | 53/504 X |

FOREIGN PATENT DOCUMENTS

| | | | |
|---|---|---|---|
| 2363486 | 5/1978 | France | 53/54 |

*Primary Examiner*—James F. Coan

*Attorney, Agent, or Firm*—Fleit & Jacobson

[57] ABSTRACT

There is provided a coin packaging machine of the type in which one packaging operation is controlled by one revolution of a cam driving shaft. The coin packaging machine is provided with an apparatus for processing irregularly stacked coins. The apparatus comprises a mechanism for detecting an irregularity in a predetermined number of stacked coins inside a cartridge, a mechanism for accepting the output of the irregularity detection mechanism at a predetermined timing and for reversing the rotation of the cam driving shaft when the irregularity is detected, a mechanism for preventing the removal of the coins from said cartridge during the reverse rotation of the cam driving shaft and within a predetermined time after the return thereof to its initial position, and a mechanism for supervising the output of the irregularity detection mechanism during the reverse rotation of the cam driving shaft and within a predetermined time after the return thereof to its initial position, and for rotating the cam driving shaft normally when the irregularity has been eliminated.

2 Claims, 8 Drawing Figures

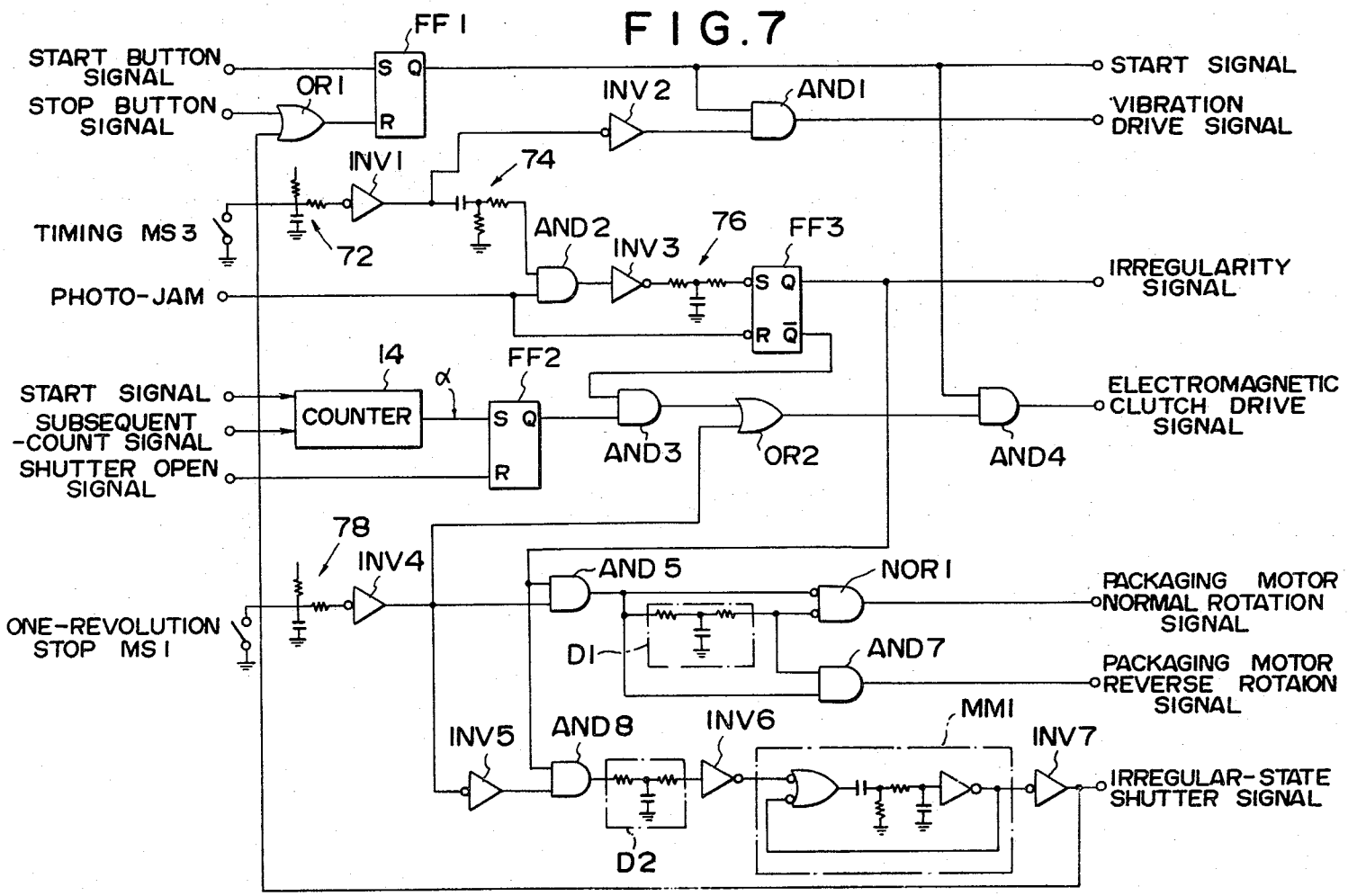
START SIGNAL
VIBRATION DRIVE SIGNAL
IRREGULARITY SIGNAL
ELECTROMAGNETIC CLUTCH DRIVE SIGNAL
PACKAGING MOTOR NORMAL ROTATION SIGNAL
PACKAGING MOTOR REVERSE ROTAION SIGNAL
IRREGULAR-STATE SHUTTER SIGNAL
START BUTTON SIGNAL
STOP BUTTON SIGNAL
TIMING MS3
PHOTO-JAM
START SIGNAL
SUBSEQUENT -COUNT SIGNAL
SHUTTER OPEN SIGNAL
ONE-REVOLUTION STOP MS1
FIG. 7
FF1
OR1
INV1
72
74
INV2
AND1
AND2
INV3
76
FF3
FF2
14
COUNTER
α
AND3
OR2
AND4
NOR1
AND5
D1
AND7
INV4
78
INV5
AND8
INV6
D2
MM1
INV7

COIN IRREGULARITY PROCESS MACHINE FOR COIN PACKAGING MACHINE

BACKGROUND OF THE INVENTION

This invention relates to an apparatus for processing coins when the coins are irregularly stacked in a coin packaging machine.

In a coin packaging machine, the coins are continuously fed into a cartridge while being selected and counted one at a time, and when the coins reach a unit number for packaging, the feed of the coins is temporarily stopped and at the same time, the stacked coins are fed into a packaging mechanism and automatically packaged. However, a so-called "irregularity" often occurs as several coins are inclined or erected inside the cartridge when stacked therein. Packaging of the coins becomes impossible when such irregularity occurs.

In the conventional apparatus, therefore, vibration is imparted to the cartridge for a predetermined period of time so as to correct the irregularity. If the irregularity is not corrected at a predetermined timing, a detector detects the irregularity, and a signal from the detector changes over a cam shaft for driving the packaging mechanism, which has already started rotating, thereby to reverse shaft rotation so that the irregularity detection function can continue. If the irregularity is corrected before the cam shaft returns to its initial position prior to the start of the packaging operation (or one-revolution stop position), the cam shaft is again returned to the normal rotation to continue the packaging operation. In the event that the irregularity is not corrected and the cam shaft returns to the one-revolution stop position, the packaging machine as a whole is stopped and the irregularly stacked coin or coins are then removed.

Depending upon the degree of irregularity, however, it often happens that the stacked state of the coins returns to the normal state if the coins are vibrated for a period of time by means of a vibration device even after the return of the cam shaft to the abovementioned one revolution stop position.

In the conventional apparatus, however, the machine as a whole is stopped to remove the coins judged as being irregular as soon as the cam shaft returns to the one revolution stop position even if it is highly likely that the irregularity can be corrected. For this reason, the packaging machine must be started again manually after the stop, thus resulting in an extremely low packaging efficiency.

SUMMARY OF THE INVENTION

It is, therefore, an object of the invention is to provide a coin irregularity processing apparatus for use in a coin packaging machine which eliminates the above mentioned disadvantages of the conventional apparatus.

In the present invention, if the irregularity is eliminated during the reverse rotation and within a predetermined period of time after the return of the cam shaft to the one-revolution stop position before the start of the packaging operation, the packaging operation is again started so as to continue counting and packaging of the coins without stopping the packaging machine as a whole. In other words, the packaging machine as a whole is stopped to remove the irregular coins only when the irregularity is not corrected even after the passage of a predetermined period of time after the return to the one-revolution stop position. In practice, however, the rate of occurrence of such a case is relatively low, allowing a remarkable improvement in the packaging efficiency to be expected in comparison with the conventional apparatus.

According to the present invention, there is provided an apparatus for processing irregularly stacked coins for use in a coin packaging machine of the type in which one packaging operation is controlled by one revolution of a cam driving shaft, comprising: means for detecting an irregularity in a predetermined number of stacked coins inside a cartridge; means for accepting the output of said irregularity detection means at a predetermined timing, and for reversing the rotation of said cam driving shaft when the irregularity is detected; means for preventing the removal of the coins from said cartridge during the reverse rotation of said cam driving shaft and within a predetermined time after the return thereof to its initial position; and means for supervising the output of said irregularity detection means during the reverse rotation of said cam driving shaft and within a predetermined time after the return thereof to its initial position, and for rotating said cam driving shaft normally when the irregularity has been eliminated.

DESCRIPTION OF THE DRAWINGS

Other objects and advantages of the present invention will become apparent from the following description made with reference to the accompanying drawings, in which:

FIG. 7 is a circuit diagram of the control circuit for controlling the packaging machine in accordance with the present invention.

DESCRIPTION OF THE PREFERRED EMBODIMENT

Figure 1:
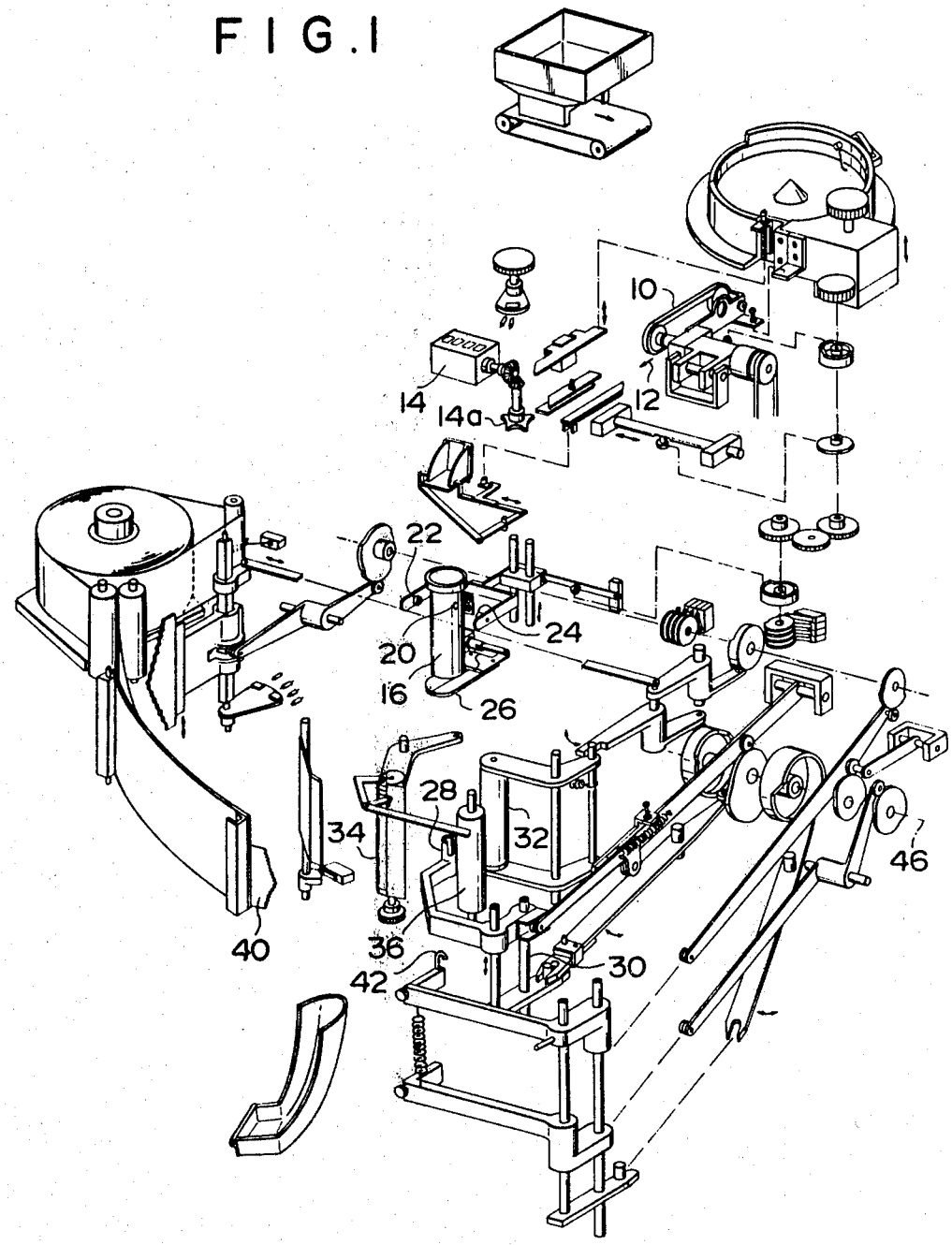
FIG. 1 is an exploded perspective view showing the arrangement of the component parts of the coin packaging machine.
Figure 2:
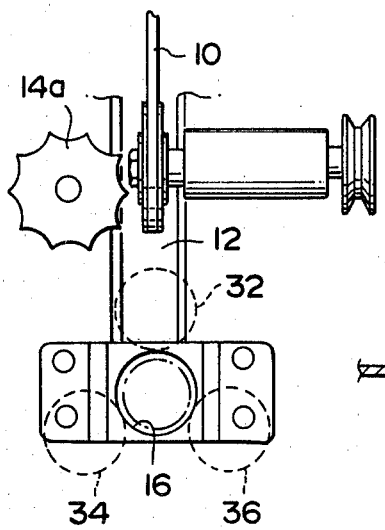
FIG. 2 is a top view of the coin counting portion.

One embodiment of the present invention will now be described in detail with reference to the accompanying drawings.

Referring to FIGS. 1 through 6, coins that are being transferred by a conveyor belt 10 through a selection path 12, turn by a predetermined angle around a star gear 14*a* of a counter 14 which is disposed by the side of the selection path 12, and advance the count of the counter by one. Thereafter, the coins fall into a cylindrical cartridge 16 disposed below the end portion of the selection path 12.

Figure 4A:
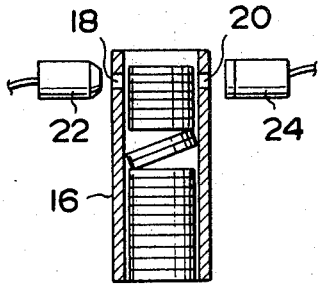
FIGS. 4*A* and 4*B* are sectional views of the stacking cartridge for showing coins in the irregularly stacked state.
Figure 4B:
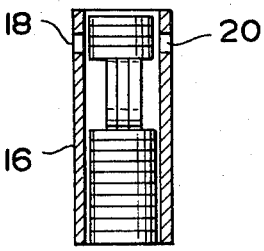
Figure 5:
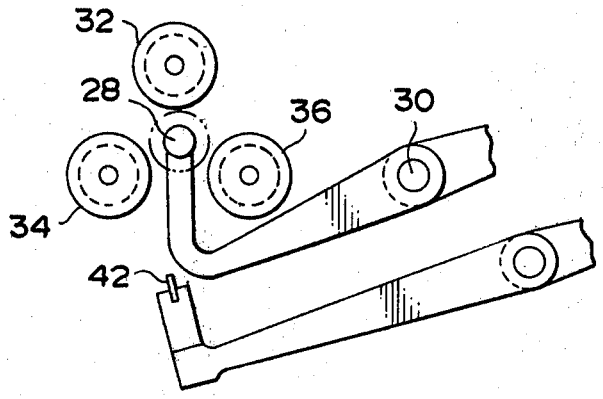
FIG. 5 is a top view of the coin packaging portion.

In the upper portion of the cartridge 16 are bored a pair of through-holes 18 and 20 that are aligned with each other in the cross-sectional direction, and a light projector 22 is disposed opposite to the through-hole 18 while a light-receiver 24 is disposed opposite to the through-hole 20. This projector 22 and receiver 24 together form a photoelectric irregularity-detecting device for detecting whether or not the coins are correctly and regularly stacked. In other words, if there is any irregularity such as shown by FIGS. 4*a* and 4*b* when a predetermined number of coins are collected and stacked inside the cartridge 16, the coins at the upper part intercept the rays of light emitted from the projector 22 through the through-hole 18 so that the receiver 24 generates an irregularity signal.

An electromagnetic shutter 26 having two double-open type plates is attached to the lowermost end of the cartridge 16.

Below the shutter 26 is disposed a coin packaging mechanism having a coin receiver 28 situated below the shutter 26. This coin receiver 28 is allowed to move up and down along a guide shaft 30 while remaining concentric with the cartridge 16. Around the coin receiver 18 are arranged three packaging rollers 32, 34 and 36 with an equiangular relationship between them. These rollers are actuated by a lower link mechanism so as to approach and separate from the axis of the shaft of the cartridge 16, and are rotated by a gear train 38.

Figure 3:
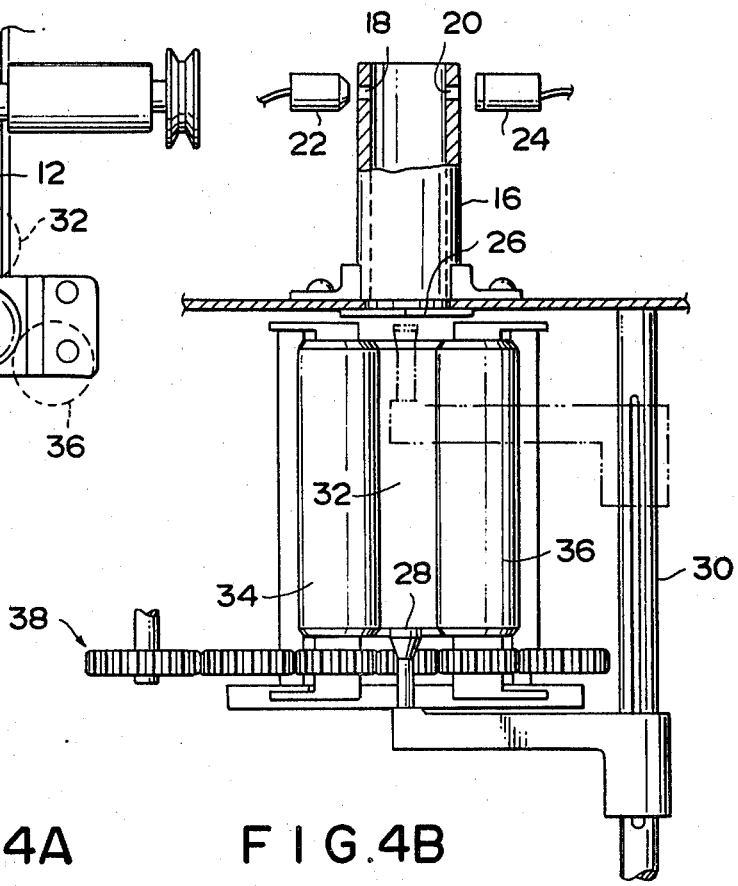
FIG. 3 is a side view of the coin stacking and packaging portion.

When a predetermined number of coins are fed into the cartridge 16 and then stacked without irregularity, the shutter 26 opens to drop the stacked coins into the coin receiver 28 which is located at the position indicated by two-dot chain line in FIG. 3. Subsequently, the coin receiver 28 lowers along the guide shaft 30 and places the stacked coins between the three packaging rollers, which then come into pressure contact with the stacked coins and wind packaging paper 40 around the coins while rotating them. Clamp pawls 42 clamp both ends of the packaging paper, thereby completing the packaging work.

The construction and operation of the apparatus so far described are already disclosed in detail in Japanese patent application No. 96417/1977 and hence, explanation in further detail is hereby omitted.

Figure 6:
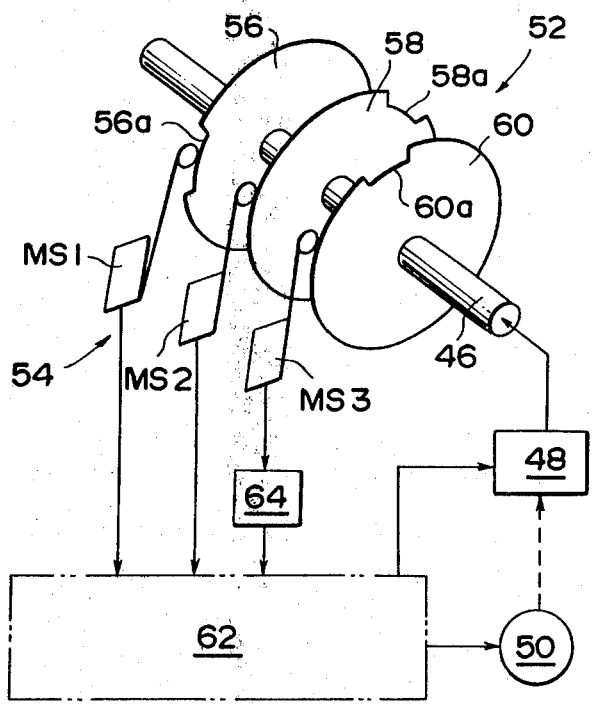
FIG. 6 is an enlarged view of a group of setting cam switches.

The sequence of the abovementioned operations is controlled by means of a one-revolution type cam shaft 46. This cam shaft 46 is actuated by a motor 50 (see FIG. 6) through an electromagnetic clutch 48 (see FIG. 6). Irregularity detection, opening of the shutter 26 and the like are controlled by a group of microswitches 54 that are actuated by a group of cams 52 fitted to the cam shaft 46. FIG. 6 shows a part of them. A cam 56 is a one-revolution stop cam; a cam 58 is a cam for normal opening of the shutter 26; and a cam 60 is a cam for detecting irregularity. These cams are furnished with recesses 56*a*, 58*a* and 60*a*, respectively. Microswitches MS1, MS2 and MS3 are engaged with these cams 56, 58 and 60, respectively, so that they are actuated by the protuberances thereof. The microswitches MS1 and MS2 are connected to a control circuit 62 while the microswitch SM3 is connected to the control circuit 62 via an irregularity detecting circuit 64. The control circuit 62 controls the clutch 48 and the motor 50.

The conventional control circuit 62 operates in the following manner. Namely, when a count end signal is generated in the counting portion, the control circuit actuates the electromagnetic clutch 48 whereby the rotation of the motor 50 is transmitted to the cam shaft 46 and the group of the cams 56, 58 and 60 fixed to the cam shaft 46 rotate counter-clockwise in the drawing. If the stacking of the coins is detected as being normal during the irregularity detection period which is determined by the cam 60, the cam 58 opens the shutter 26 so that the stacked coins are transferred into the coin receiver 28 and then packaged by the rollers. The cam 56 then deactuates the electromagnetic clutch 48 and the cam shaft 46 stops at the position of one-revolution stop.

If an irregularity is detected during the detection period, the control circuit reverses the rotation of the motor 50, thereby allowing the cam shaft 46 to rotate clockwise. The irregularity detection continues until the cam shaft returns to its initial position, that is, the one-revolution stop position. If the irregularity is corrected during this period, the control circuit again reverses the motor so that the cam shaft is rotated in the proper direction and is permitted to perform the abovementioned packaging operation. If the irregularity is not corrected and the cam shaft returns to the one-revolution stop position, the packaging machine as a whole is stopped so as to remove the irregularly stacked coin.

In comparison with the conventional control circuit explained above, the object of the present invention is accomplished by the control circuit such as shown in FIG. 7.

In FIG. 7, a start button signal and a stop button signal are signals from start and stop-buttons for starting and stopping the counting packaging actions, respectively. When the start button is depressed, a high level start button signal is applied to a set input S of a flip-flop FF1 and when the stop button is depressed, a high level stop button signal is applied to a reset input R via an OR gate OR1. It will now be assumed that the cam shaft 46 is at the one-revolution stop position. In this case, an NC contact (normally closed contact) of MS3 and an NO contact (normally open contact) of MS1 are in the open state. Due to the start button signal, the Q output of FF1 goes to a high level, which is a start signal, and is delivered to the counter or the like. A subsequent-count signal is a signal for paper-cut detection when the regularly stacked coins are sent to the packaging portion and packaged there. Upon confirming the start of packaging, this signal starts the subsequent counting. A shutter-open signal is a signal for detecting the opening of the shutter irrespective of the regular or irregular stacking of the coins. A photo-jam signal is a signal which appears during the occurrence of an irregularity. In the embodiment described, this signal is generated by the photo-receiver 24 of the photoelectric detector and goes to a high level when the coins are irregularly stacked. Any irregularity detector may be used in the present invention so long as it is able to detect the irregularity at all times.

MS3 is grounded at one of its contacts and connected to an inverter INV1 at its other contact through a voltage signal generation circuit 72. When MS3 is closed, therefore, the output of the inverter INV1 is at a high level and when MS3 is open, the output of INV1 is at a low level. The output of INV1 is fed to one of the inputs of an AND gate AND1 through an inverter INV2 and the other input of the AND gate AND1 is connected to the Q output of FF1. The output of AND1 is a vibration motor drive signal. This vibration motor drive signal is a drive signal for a heretofore known vibration generator which vibrates the cartridge in order to reduce irregularities in the stacked coins. The arrangement is such that the vibration will occur during the irregularity detection period which is determined by the cam 60.

The output of INV1 is further connected to one of the inputs of an AND gate AND2 through a CR circuit 74. The photo-jam signal is impressed upon the other input of AND gate AND2. The output of AND2 is connected to a set input S of the flip-flop FF3 through an inverter 3 and through a noise-removing filter circuit 76. The output of this FF3 is an irregularity signal. This signal is retained by FF3 if an irregularity occurs while the NC contact of MS3 is closed by the cam 60, and remains in this state until the irregularity is corrected and the photo-jam signal, which is also sent to the reset input R of FF3, goes to a low level to reset FF3.

A counter 14 starts counting the coins when applied with the start signal or with the subsequent-count signal. When the content of the counter reaches a prescribed count, the counter 14 delivers a count-end signal to the set input of the flip-flop FF2, thereby setting FF2. A shutter-open signal is sent to the reset input of FF2. The Q output of FF2 is connected to one of the inputs of the AND gate AND3 while the other input of AND3 is connected to the $\overline{Q}$ output of FF3. The output of AND3 is connected to one of the inputs of an AND gate AND4 via the OR gate OR2, while the other input of AND4 is connected to the Q output of FF1. The AND gate AND4 produces an electromagnetic clutch signal which actuates the electromagnetic clutch 48.

One of contacts of the one revolution stop microswitch MS1 is grounded and the other is connected to an inverter INV4 via the voltage signal generation circuit 78. The output of INV4 therefore goes to a high level when MS1 is closed and to a low level when it is open. The output of INV4 is connected to the input of OR2 and also to one of the inputs of an AND gate AND5. The other input of this AND5 is connected to the Q output of FF3 and its output is directly connected to one of the inputs of NOR gate NOR1 and AND gate AND7 and indirectly connected to the other inputs via a delay circuit D1. The output of NOR1 is a packaging motor normal rotation signal and the output of AND7 is a packaging motor reverse rotation signal.

The output of INV4 is further connected to one of the inputs of an AND gate AND8 via an inverter INV5. The other output of AND8 is connected to the Q output of FF3. The output of AND8 is applied to a monostable multiple vibrator MM1 via a delay circuit D2 and an inverter INV6, and the output of MM1 is connected to an inverter INV7. The output of this INV7 is an irregular-time shutter signal for opening the shutter 26 for a predetermined period of time when the coins are irregularly stacked. This signal is sent via OR1 to the reset input R of FF1 which retains the start signal, thereby stopping the packaging machine as a whole.

Next, the operation of the control circuit of the present invention shown in FIG. 7 will be explained.

When the start button is depressed, the start button signal is applied to the S input of FF1 and the Q output of this FF1 goes to a high level. This high level start signal is delivered to the counter 14 and causes it to start counting. In this instance, since the NC contact of MS3 is open, a high level signal, or an H signal, is impressed upon the other input of AND1 via the INV1 and INV2 so that the output of AND1 goes to a high level. In consequence, the vibration device starts operating and vibrates the cartridge 4. The start signal also opens the gate of AND4. In this instance, the NO contact of MS1 is open and the INV4 output is at a low level, or issues an L signal. Since the count-end signal $\alpha$ has not yet been generated by the counter and FF2 is in the reset state, the output of AND3 goes to a low level and hence, the OR2 output also goes to a low level. Consequently, the electromagnetic clutch 48 is not actuated. Due to the low level output of INV4, further, the AND5 output goes to a low level whereby the NOR1 output goes to a high level and the AND7 output goes to a low level. The packaging motor 50 is rotating in the normal or forward direction. Since the irregularity signal is at a low level, the irregularity shutter signal remains at a low level.

When counting is completed, the count-end signal $\alpha$ is delivered by the counter to set FF2. Since the NC of MS3 is still open at this time whether or not the coins are stacked irregularly, the $\overline{Q}$ output of FF3 is at a high level. Hence, the AND3 output goes to a high level and the high level signal is delivered by AND4 via OR2 so that the electromagnetic clutch 48 is excited and the cam shaft 46 is rotated. Then, the NO contact of MS1 is grounded and the INV4 output goes to a high level and remains in this state until the initial one-revolution stop position (the open state of the NO contact of MS1) is restored irrespective of the AND3 output.

As the cam shaft 46 rotates and the microswitch MS3 of the timing cam 60 engages with the recess of the cam thereby to ground the NC contact of MS3, the output of INV1 goes to a high level, which is sent to AND1 via INV2. Accordingly, the vibration drive signal attains the low level and the vibration stops. Simultaneously, the signal is applied to the CR circuit 74 and opens the gate of AND2 for a predetermined period of time, thereby passing the photo-jam signal through INV3 and carrying out the irregularity detection. If the coins have already been stacked regularly in this case, FF3 is not set because the photo-jam signal is at a low level. In consequence, no irregularity signal is produced and the normal rotation signal continues to be applied to the packaging motor.

In this manner, as the cam shaft rotates further and the signal from microswitch MS2 of the normal-state open cam 58 opens the shutter 26, the coins move into the coin receiver 28 that has been waiting for them immediately below the shutter. The coin receiver 28 descends to the packaging mechanism, where the coins are packaged. The shutter-opening signal resets FF2 and the subsequent-count signal is generated during the packaging operation. Hence, the counter resumes operation. When the cam shaft rotates one more revolution, the NO contact of MS1 is opened so that the Q output of INV4 goes to a low level and, since the Q output of FF2 is already at a low level, the OR2 output goes to a low level. As a result, the transmission of the driving power by the electromagnetic clutch 48 to the cam shaft 46 is interrupted and the rotation of the cam shaft 46 stops at the one-revolution stop position.

If the irregularity of the coins is not eliminated at the point in time when the gate of AND2 has been opened for a predetermined period of time after the cam shaft 46 is rotated by the count-end signal $\alpha$ and the NC contact of MS3 is grounded, FF3 is set through AND2, INV3 and the noise-removing filter circuit 76 thereby to deliver a high level irregularity signal. Due to this high level irregularity signal, the AND5 output is changed over to the high level and renders NOR1 to be at a low level, and at the same time, changes the AND7 output into the high level after a slight delay through the delay circuit D1, thereby rotating the packaging motor in the opposite direction. This delay circuit D1 is provided as reaquired by driving design conditions considering such factors of the packaging motor as inertia. Though the irregularity signal is also applied to AND8, the AND8 output remains at a low level since it is not the one-revolution stop position of the cam.

When the irregularity is eliminated during the reverse rotation, the photo-jam signal goes to a low level, whereupon FF3 is immediately reset and the AND5 output goes to a low level. After the AND7 output is first changed to the low level, the capacitor of the delay circuit D1 discharges and the high level (normal rotation signal) is delivered by AND6. Hence, the action is changed over to the packaging action.

If the irregularity is not eliminated during the reverse rotation and the cam returns to its one-revolution stop position, the NO contact of MS1 is opened and hence, the reverse rotation signal of the motor changes to the normal rotation signal. Due to the opening of the NC contact of MS3 during the reverse rotation, the vibration driving signal is delivered to resume vibration of the cartridge 16. Since the INV4 output is at a low level and the irregularity is not eliminated, the $\overline{Q}$ output of FF3 is at a low level. Accordingly, the electromagnetic clutch is deactuated and the cam stops at the one-revolution stop position. The output of AND8 is applied to the delay circuit D2 so as to set the delay time within the range of 1–1.5 seconds, for example. If the irregularity has not yet been eliminated when the time exceeds this set time, the low level signal is put out from INV6 and an irregular-state shutter signal consisting of pulses of a predetermined (optional) period is delivered from the mono-stable multiple vibrator MM1, which output pulses open the shutter 26 to exclude the irregular coin or coins. At the same time, FF2 is reset by the output pulses. The irregular-state shutter signal is further applied to the R input of FF1 via the OR1, thereby resetting the start-retaining signal and the packaging machine. However, if the irregularity is eliminated by the vibration within 1–1.5 seconds after the return to the one-revolution stop position, FF3 is reset and changes the AND8 output to the low level, thereby inhibiting the operation of the mono-stable multiple vibration MM1. Since the Q output of FF2 is at a high level due to the high level signal from the $\overline{Q}$ output of FF3, the electromagnetic clutch is again excited to change the operation of the machine to the packaging operation.

As described above, the apparatus of the present invention changes to the reversing operation when an irregularity is detected. Since the detection of the irregularity is consecutively carried out, however, the apparatus again shifts to the packaging operation if the irregularity is eliminated not only during the reversing operation but also within a predetermined time after the return to the one-revolution stop position. Accordingly, the exclusion rate of the irregular coins and the idle rate of the machine can be drastically reduced, allowing an overall improvement in the efficiency of the machine.

What is claimed is:

1. In a coin packaging machine of the type in which one packaging operation is controlled by one revolution of a cam driving shaft, an apparatus for processing irregularly stacked coins comprising:

means for detecting an irregularity in a predetermined number of stacked coins inside a cartridge;

means for accepting the output of said irregularity detection means at a predetermined timing, and for reversing the rotation of said cam driving shaft when the irregularity is detected;

means for preventing the removal of the coins from said cartridge during the reverse rotation of said cam driving shaft and within a predetermined time after the return thereof to its initial position; and means for supervising the output of said irregularity detection means during the reverse rotation of said cam driving shaft and within a predetermined time after the return thereof to its initial position, and for rotating said cam driving shaft normally when the irregularity has been eliminated.

2. The apparatus for processing irregularly stacked coins as defined in claim 1, wherein said cartridge is vibrated for predetermined period of time after the return of said cam driving shaft to its initial position.

* * * * *